US010064537B2

(12) United States Patent
Welch

(10) Patent No.: US 10,064,537 B2
(45) Date of Patent: Sep. 4, 2018

(54) DISHWASHER DRAIN ASSEMBLIES HAVING OVERMOLDED VOLUTES

(71) Applicant: Whirlpool Corporation, Benton Harbor, MI (US)

(72) Inventor: Rodney M. Welch, Eau Claire, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 564 days.

(21) Appl. No.: 14/551,131

(22) Filed: Nov. 24, 2014

(65) Prior Publication Data

US 2016/0143504 A1 May 26, 2016

(51) Int. Cl.

| | |
|---|---|
| ***A47L 15/42*** | (2006.01) |
| ***F04D 29/40*** | (2006.01) |
| ***F04D 29/42*** | (2006.01) |
| *A47L 15/00* | (2006.01) |

(52) U.S. Cl.

CPC ..... *A47L 15/4223* (2013.01); *A47L 15/4225* (2013.01); *F04D 29/4293* (2013.01); *A47L 15/0052* (2013.01)

(58) Field of Classification Search

CPC ..... A47L 15/4223; A47L 15/4225; A47L 15/0052; F04D 29/4293

USPC ..... 134/56 D

See application file for complete search history.

(56) References Cited

U.S. PATENT DOCUMENTS

| | | | | |
|---|---|---|---|---|
| 3,018,650 | A * | 1/1962 | Schmidt | D06F 39/085 415/200 |
| 3,867,071 | A * | 2/1975 | Hartley | F04B 49/025 137/202 |
| 5,131,420 | A * | 7/1992 | Favret | A47L 15/4225 134/104.1 |
| 6,189,550 | B1 | 2/2001 | Stickel et al. | |
| 7,594,513 | B2 | 9/2009 | Vanderroest et al. | |
| 8,034,276 | B2 | 10/2011 | Welch | |
| 8,297,660 | B2 | 10/2012 | Rosch | |
| 8,425,205 | B2 | 4/2013 | Li et al. | |
| 2007/0246089 | A1 * | 10/2007 | Welch | A47L 15/0084 134/56 D |
| 2011/0315174 | A1 | 12/2011 | Pyo et al. | |
| 2014/0134010 | A1 | 5/2014 | Lundberg et al. | |

FOREIGN PATENT DOCUMENTS

| | | | |
|---|---|---|---|
| EP | 1847210 | A2 | 10/2007 |
| EP | 1956263 | A1 | 8/2008 |
| EP | 2233744 | A2 | 9/2010 |

(Continued)

OTHER PUBLICATIONS

European Search Report for Counterpart EP15194072.3, dated May 3, 2016.

*Primary Examiner* — Michael E Barr
*Assistant Examiner* — Tinsae B Ayalew
(74) *Attorney, Agent, or Firm* — McGarry Bair PC

(57) ABSTRACT

Dishwasher drain assemblies having overmolded volutes are disclosed. A disclosed example drain assembly for a dishwasher having a tub, a sump fluidly coupled to the tub, and a discharge outlet includes a drain pump having an impeller to pump fluid from the sump to the discharge outlet, and a resilient member overmolded onto at least a portion of the drain pump, the resilient member defining a volute for the drain pump.

17 Claims, 9 Drawing Sheets

(56) References Cited

FOREIGN PATENT DOCUMENTS

| | | | |
|---|---|---|---|
| EP | 2430968 | A2 | 3/2012 |
| GB | 750997 | | 6/1956 |
| GB | 2049406 | A | 12/1980 |

* cited by examiner

DISHWASHER DRAIN ASSEMBLIES HAVING OVERMOLDED VOLUTES

FIELD OF THE DISCLOSURE

This disclosure relates generally to dishwashers, and, more particularly, to dishwasher drain assemblies having overmolded volutes.

BACKGROUND

Conventional dishwashers perform cycles of operation on items present in the dishwasher, and have a drain assembly that drains fluids from a sump of the dishwasher to a discharge outlet.

SUMMARY

A disclosed example drain assembly for a dishwasher having a tub, a sump fluidly coupled to the tub, and a discharge outlet includes a drain pump having an impeller to pump fluid from the sump to the discharge outlet, and a resilient member overmolded onto at least a portion of the drain pump, the resilient member defining a volute for the drain pump.

A disclosed example drain pump volute for a dishwasher having a tub, a sump fluidly coupled to the tub, and drain pump to transfer fluid from the sump to a discharge outlet includes a first portion overmolded onto the drain pump, a second portion defining the discharge outlet for fluidly coupling the drain pump to a domestic drain, and a third portion defining a generally hollow protrusion dimensioned corresponding to an opening in the sump, the protrusion having a lip extending around a distal end of the protrusion, the lip engaging an interior surface of the sump adjacent the sump opening to generally prevent the protrusion from being removed from the sump.

An air vent including a surface having a hole defined therethrough, at least a portion of the surface sloping downward toward the hole, and a flexible member positioned across the portion of surface, the flexible member flexing toward and sealably engaging the hole when a force presses the flexible member, and the flexible member positioned away from the hole allowing air to pass through the hole when the force does not press the flexible member.

DETAILED DESCRIPTION

Figure 1:
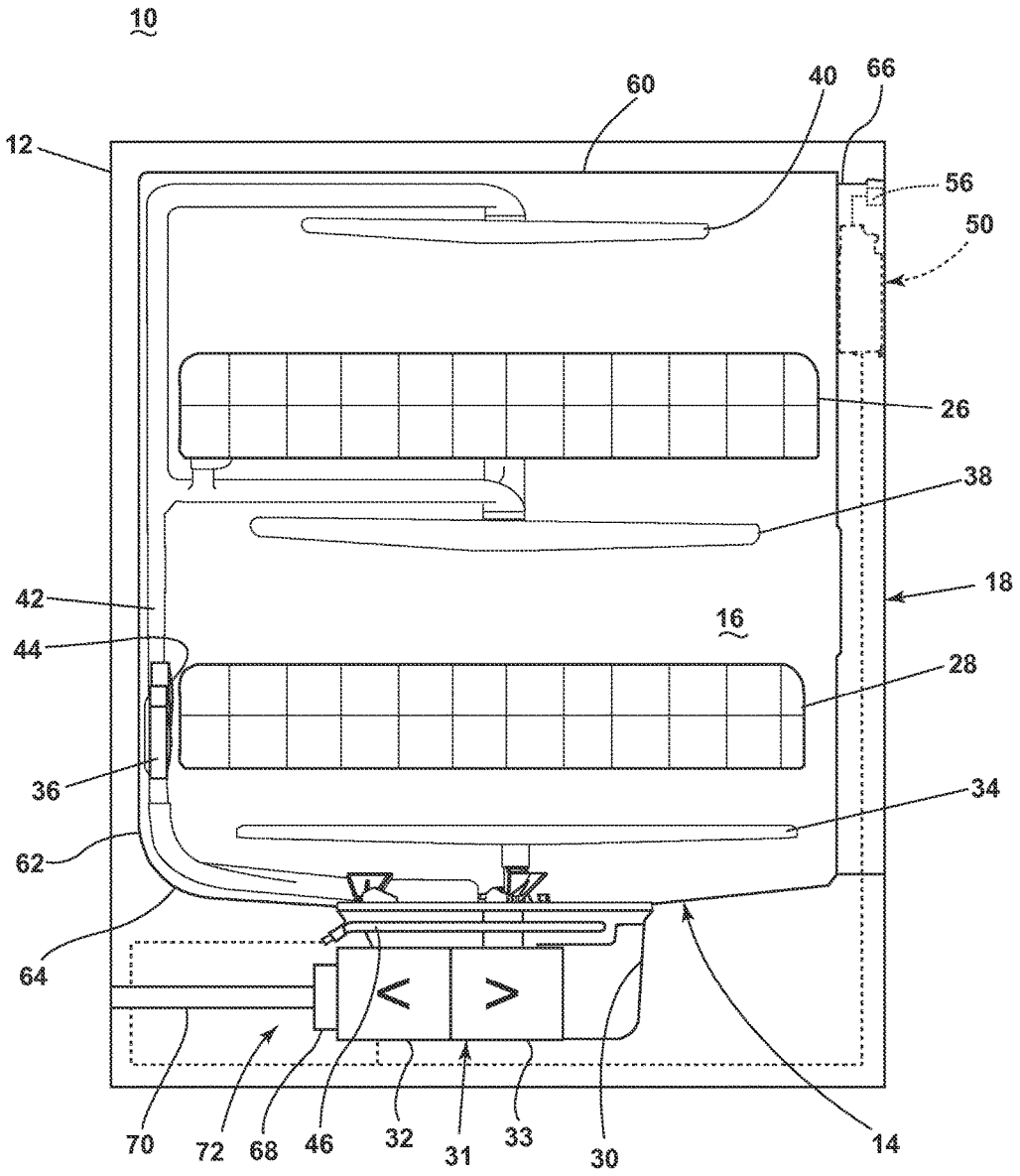
FIG. 1 is a schematic view of an example dishwasher including a drain pump having an overmolded volute constructed in accordance with the teachings of this disclosure.

In conventional dishwashers, a drain pump often in the form of a motor-impeller component is installed onto a sump, which has an integrally molded volute. Unfortunately, this arrangement couples vibrations of the drain pump motor to the sump, where it is amplified and radiated by the large surfaces of the dishwasher. Such noises may reduce customer satisfaction. Also, the O-ring seals used to couple the drain pump to the sump may leak due to the low precision nature of typical final assembly stages. Further, conventional drain vent solutions require consideration of how air is vented from the drain pump volute during fill. Trapped air can air lock the drain pump and prevent it from starting or running full flow and pressure. Typically, the inlet geometry is designed so air below the top of the inlet port has a way to escape through the inlet. However, if water needs to be drained from below the inlet, the inlet needs a downturn, which may prevent venting of air via the inlet. In some sump designs, this requires the radius of the drain pump volute to be below the bottom of the sump so that it is at the lowest point, thus insuring that the pump doesn't have a down turn in the inlet. However, such a design complicates the design of low-height wash systems.

The overmolded drain pump volutes and drain assemblies having the same that are disclosed herein overcome at least these problems. In disclosed examples, a resilient, e.g., rubber, volute is overmolded onto a drain pump (e.g., a motor-impeller) and is compress sealed into a hole in a sump, thereby eliminating need for a seal at the pump-volute interface. Instead, the seal is moved forward to the front of the volute, thus providing adequate length for vibration isolation. Because the overmolded volute provides noise isolation, need for a longer noise-isolation hose is eliminated. Further, because the rubber volute readily seals to the drain pump and sump, need for the conventional, and sometimes leaky, O-ring is eliminated.

Disclosed rubber overmolded volutes have a protrusion including a lip that flexes during initial assembly and catches on the inside surface of the sump to which the drain pump is coupled. A bulkhead, which may be inserted into the protrusion of the volute from inside the sump, compresses a sealing rib of the protrusion against a cylindrical sealing surface of the sump, and also locks it in place so that the hooked protrusion is prevented from flexing inward.

Disclosed example air check valves may be positioned high in the bulkhead to allow air to vent during fill while the pump is not on. When there is no pressure in the volute, a rubber member of the check valve is not forced against the back of the bulkhead, thus, providing air an escape path. When the pump runs, there is pressure inside the volute that forces the rubber member of the check valve against the bulkhead, thus, preventing leakage of dirty water back into the sump.

Since the volute and its discharge outlet are an integral overmolded rubber member in disclosed examples, the drain hose does not need an overmold. Instead, a clamp can readily seal the volute discharge outlet to the hard plastic end of the drain hose.

As used herein, terms such as up, down, top, bottom, side, end, front, back, etc. are used with reference to the normal orientation of a member, element, item, assembly, etc. If any of these is considered with respect to another orientation, it should be understood that such terms need to be correspondingly modified.

Reference will now be made in detail to embodiments of this disclosure, examples of which are illustrated in the accompanying drawings. The embodiments are described below by referring to the drawings, wherein like reference numerals refer to like elements. Here, configurations of example dishwashers according to this disclosure will be described with reference to FIGS. 1-17.

In FIG. 1, an automated dishwasher 10 according to a first embodiment is illustrated. The dishwasher 10 shares many well known features of a conventional automated dishwasher, which will not be described in detail herein except as necessary for a complete understanding of this disclosure. A chassis 12 defines an interior of the example dishwasher 10 and may include a frame, with or without panels mounted to the frame. An open-faced tub 14 is within the chassis 12 and may at least partially define a treating chamber 16, having an open face, for washing dishes. A door assembly 18 is movably mounted to the dishwasher 10 for movement between opened and closed positions to selectively open and close the open face of the tub 14. Thus, the door assembly provides accessibility to the treating chamber 16 for the loading and unloading of dishes or other washable items.

It should be appreciated that the door assembly 18 may be secured to the lower front edge of the chassis 12 or to the lower front edge of the tub 14 via a hinge assembly (not shown) configured to pivot the door assembly 18. When the door assembly 18 is closed, user access to the treating chamber 16 is prevented, whereas user access to the treating chamber 16 is permitted when the door assembly 18 is open.

Dish holders, illustrated in the form of upper and lower dish racks 26, 28, are located within the treating chamber 16 and receive dishes for washing. The upper and lower racks 26, 28 are typically mounted for slidable movement in and out of the treating chamber 16 for ease of loading and unloading. Other dish holders may be provided, such as a silverware basket. As used in this description, the term "dish(es)" is intended to be generic to any item, single or plural, that may be treated in the dishwasher 10, including, without limitation, dishes, plates, pots, bowls, pans, glassware, silverware, any other washable item.

A spray system is provided for spraying liquid in the treating chamber 16 and is provided in the form of a first lower spray assembly 34, a second lower spray assembly 36, a rotating mid-level spray arm assembly 38, and/or an upper spray arm assembly 40. Upper sprayer 40, mid-level rotatable sprayer 38 and lower rotatable sprayer 34 are located, respectively, above the upper rack 26, beneath the upper rack 26, and beneath the lower rack 24 and are illustrated as rotating spray arms. The second lower spray assembly 36 is illustrated as being located adjacent the lower dish rack 28 toward the rear of the treating chamber 16. The second lower spray assembly 36 is illustrated as including a vertically oriented distribution header or spray manifold 44. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system is provided for recirculating liquid from the treating chamber 16 to the spray system. The example recirculation system includes a sump 30 and a pump assembly 31. The sump 30 collects the liquid sprayed in the treating chamber 16 and may be formed by a sloped or recess portion of a bottom wall of the tub 14. The pump assembly 31 may include both a drain pump 32 and a recirculation pump 33. The drain pump 32 may draw liquid from the sump 30 and pump the liquid out a discharge outlet 68 of the dishwasher 10 to a household or domestic drain (not shown) via, for example, a hose 70, thus forming a drain assembly 72. The recirculation pump 33 may draw liquid from the sump 30 and the liquid may be simultaneously or selectively pumped through a supply tube 42 to each of the assemblies 34, 36, 38, 40 for selective spraying. While not shown, a liquid supply system may include a water supply conduit coupled with a household water supply for supplying water to the treating chamber 16.

A heating system including a heater 46 may be located within the sump 30 for heating the liquid contained in the sump 30.

A controller 50 may also be included in the dishwasher 10, which may be operably coupled with various components of the dishwasher 10 to implement a cycle of operation. The controller 50 may be located within the door 18 as illustrated, or it may alternatively be located somewhere within the chassis 12. The controller 50 may also be operably coupled with a control panel or user interface 56 for receiving user-selected inputs and communicating information to the user. The user interface 56 may include operational controls such as dials, lights, switches, and displays enabling a user to input commands, such as a cycle of operation, to the controller 50 and receive information.

Figure 2:
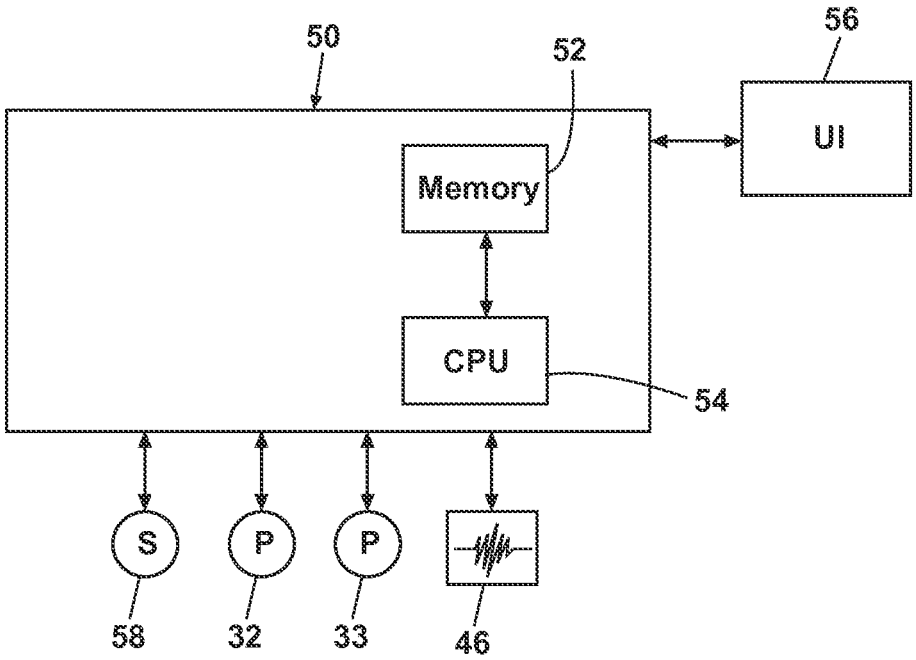
FIG. 2 is a schematic of an example control system for the example dishwasher of FIG. 1.
Figure 3:
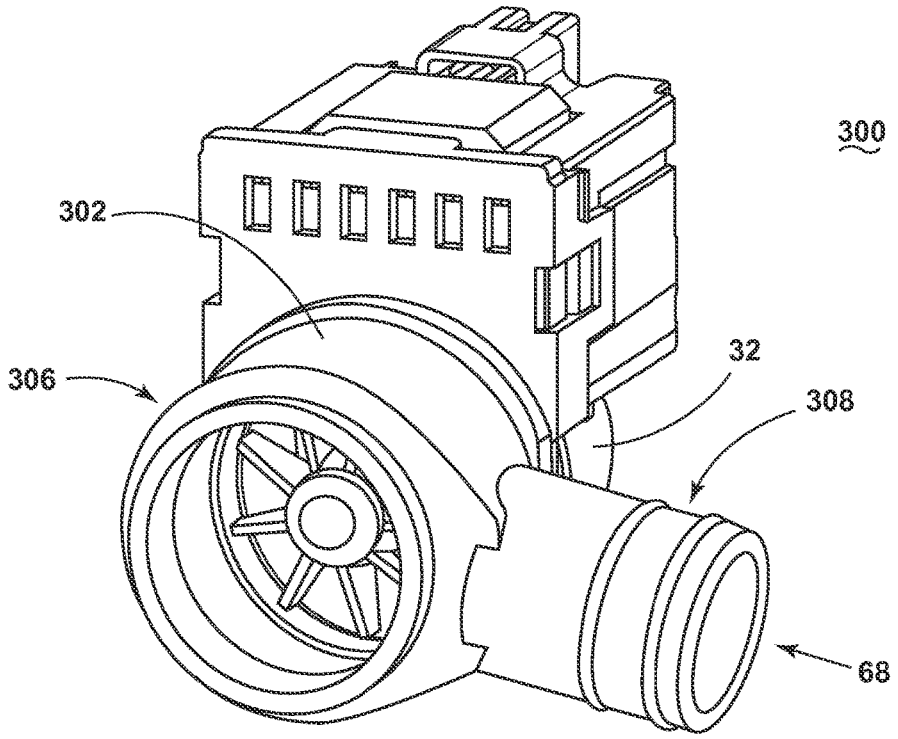
FIG. 3 is a front isometric perspective view of an example overmolded volute constructed in accordance with the teachings of this disclosure.
Figure 4:
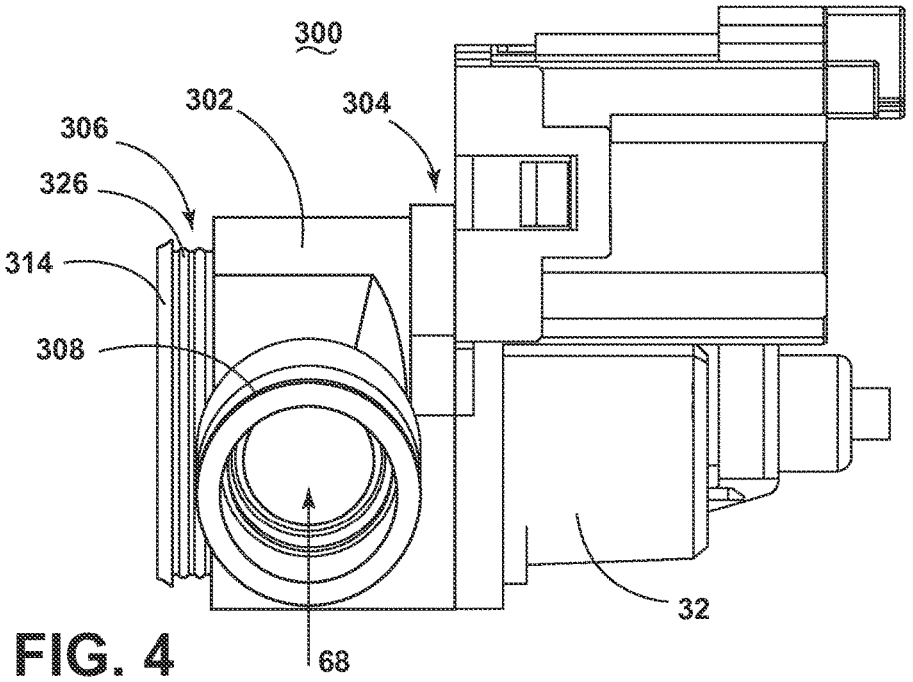
FIG. 4 is a side view of the example overmolded volute of FIG. 3.

As illustrated schematically in FIG. 2, the controller 50 may be coupled with the heater 46 for heating the wash liquid during a cycle of operation, the drain pump 32 for draining liquid from the treating chamber 16, and the recirculation pump 33 for recirculating the wash liquid during the cycle of operation. The controller 50 may be provided with a memory 52 and a central processing unit (CPU) or processor 54. The processor 54 can be implemented by, for example, one or more Atmel®, Intel®, AMD®, and/or ARM® microprocessors. Of course, other processors from other processor families and/or manufacturers are also appropriate.

The memory 52 may be used for storing control software that may be executed by the CPU 54 in completing a cycle of operation using the dishwasher 10 and any additional software. For example, the memory 52 may store one or more pre-programmed cycles of operation that may be selected by a user and completed by the dishwasher 10. The memory 52 may include volatile memory such as synchronous dynamic random access memory (SDRAM), a dynamic random access memory (DRAM), RAMBUS® dynamic random access memory (RDRAM) and/or any other type of random access memory (RAM) device(s); and/or non-volatile memory such as flash memory(-ies), or flash memory device(s).

The controller 50 may also receive input from one or more sensors 58. Non-limiting examples of sensors that may be communicably coupled with the controller 50 include a temperature sensor and turbidity sensor to determine the soil load associated with a selected grouping of dishes, such as the dishes associated with a particular area of the treating chamber.

Turning to FIGS. 3-9, an example manner of implementing the drain assembly 72 of FIG. 1 is shown. The example drain assembly 300 of FIGS. 3-9 includes the sump 30 and the drain pump 32 of FIG. 1, and a resilient (e.g., rubber) member in the form of a volute 302 overmolded onto the pump 32. As shown, the example overmolded volute 302 has a first portion 304 that is overmolded onto a portion of the drain pump 32, a second portion 306 that fluidly couples the volute 302 to the sump 30 (e.g., see FIGS. 5 and 6), and a third portion 308 that forms the discharge outlet 68 (e.g., see FIG. 15). As shown in at least FIG. 7, the example motor 32 includes a rotor 32A and an impeller 32B.

Figure 7:
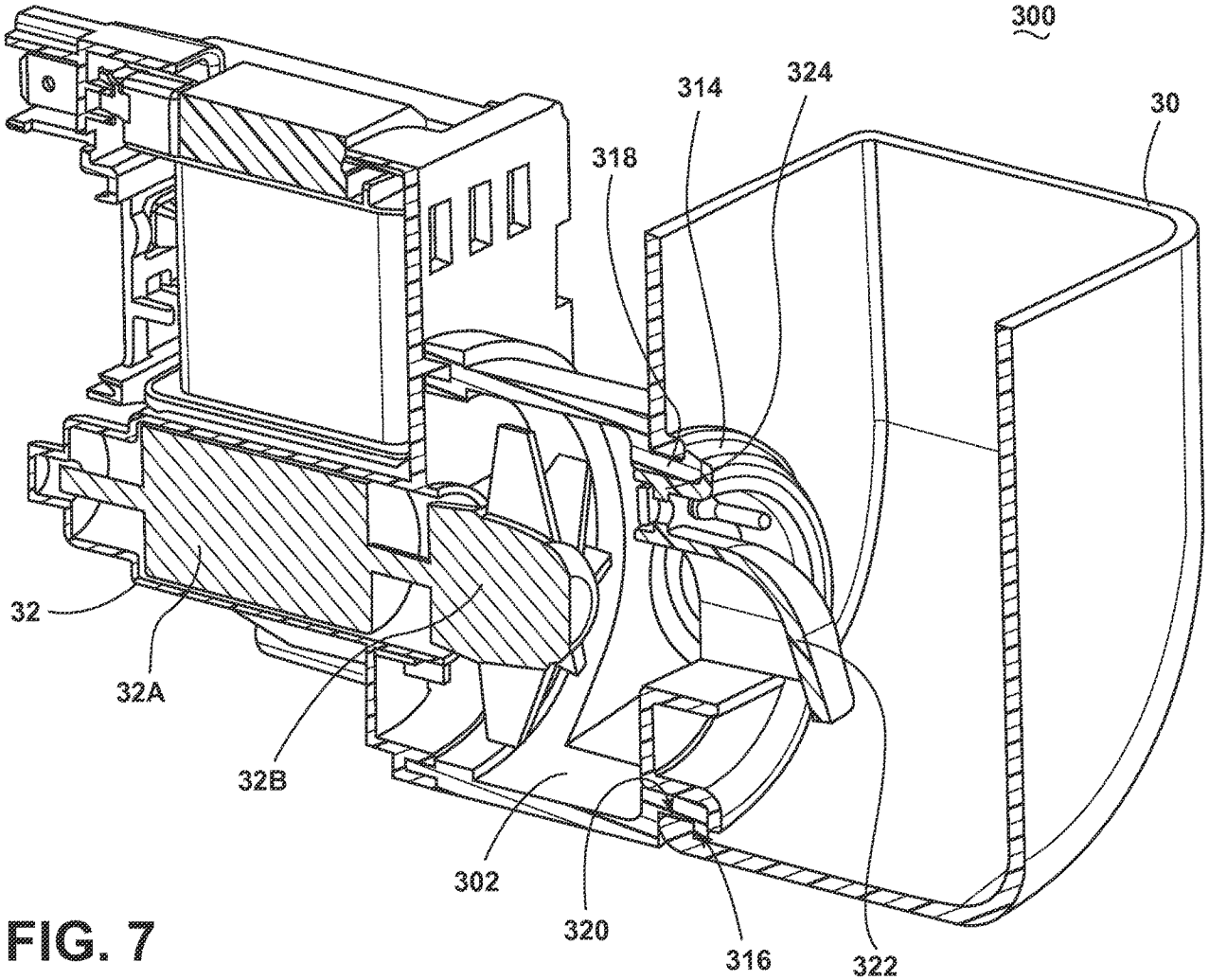
FIGS. 7 and 8 are side cross-sectional views of the example volute-sump combination of FIG. 5.
Figure 8:
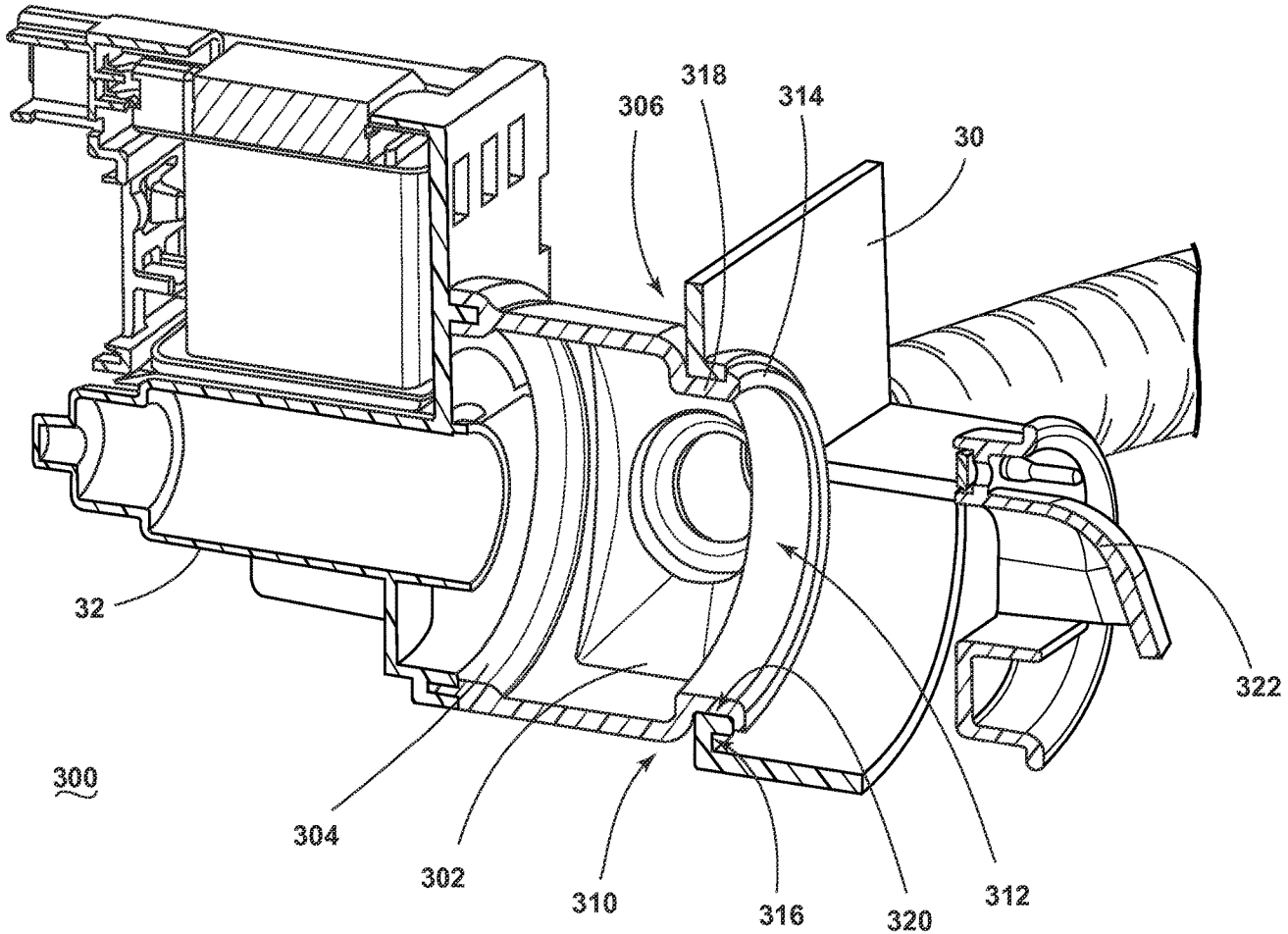

An example manner of fluidly coupling the volute 302 and the sump 30 is shown in at least FIGS. 7 and 8. The example second portion 306 is hollow and is assembled to the sump 30 by passing the end 310 of the portion 306 through an opening 312 defined through the sump 30. As the end 310 passes through the opening 312, a lip or edge 314 at the end 310 engages a surface 316 around the opening 312. Moreover, a part 318 of the portion 306 adjacent the lip 314 engages an inner surface 320 of the opening 312.

Figure 9:
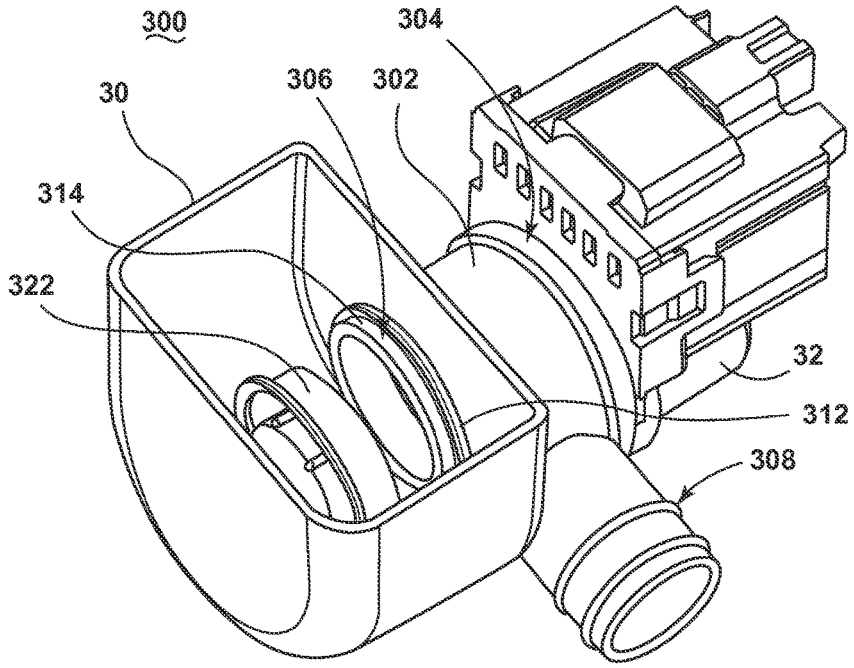
FIG. 9 is a partial exploded view of the example volute-sump combination of FIG. 5.
Figure 10:
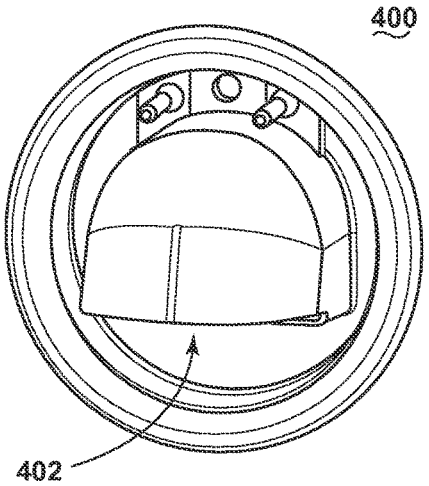
FIGS. 10 and 11 are front and rear isometric perspective views of the example bulkhead of FIG. 9.
Figure 11:
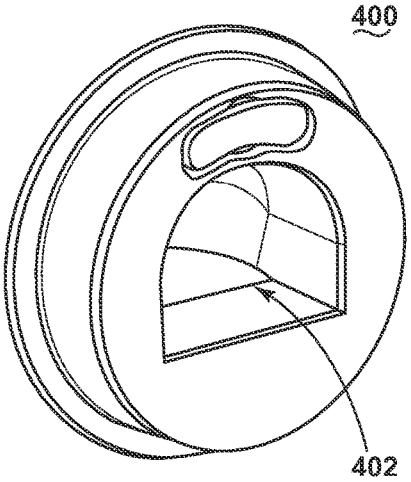
Figure 14:
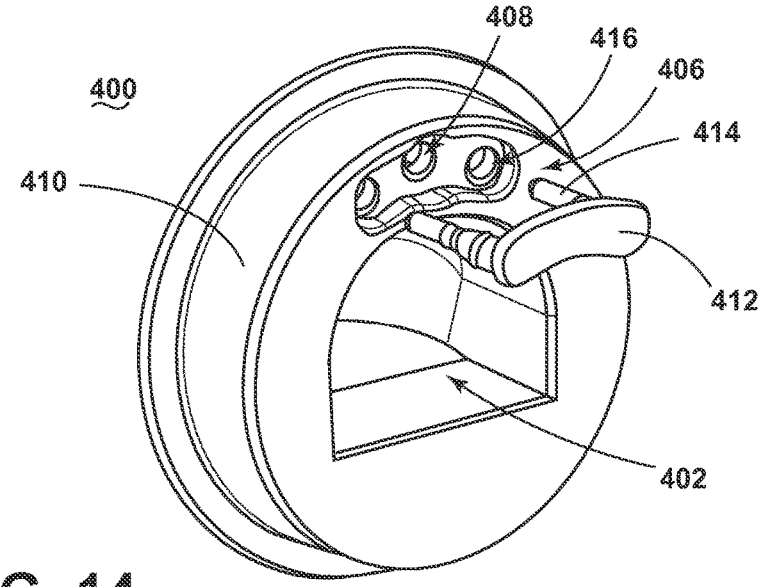
FIG. 14 is an exploded view of the example bulkhead of FIGS. 9-13.
Figure 12:
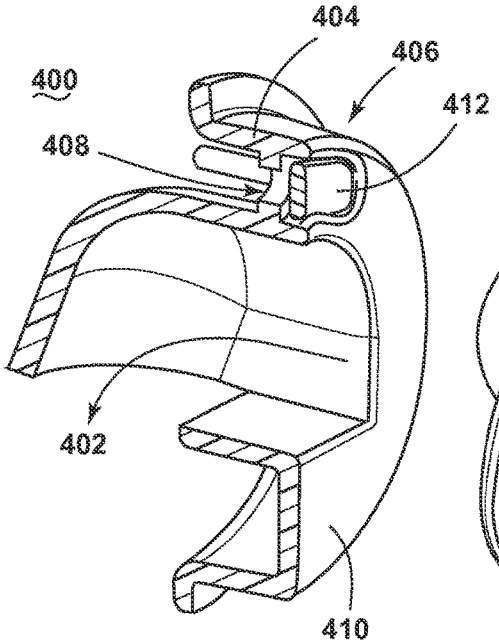
FIGS. 12 and 13 are side and top cross-sectional views of the example bulkhead of FIGS. 9-11.
Figure 13:
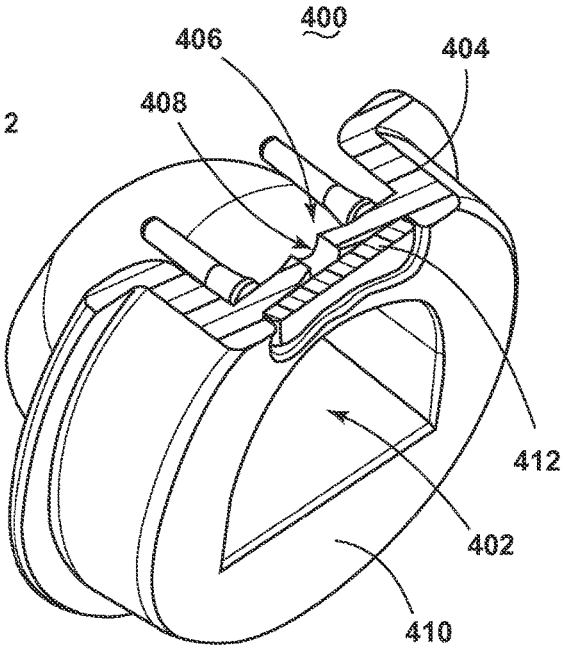

As shown in at least FIGS. 8 and 9, a bulkhead 322 is inserted from the sump 60 into the end 310 into the engaged position shown in at least FIG. 7. In the engaged position, an L-shaped peripheral 324 of the example bulkhead 322 (com-)presses the part 318 of the portion 306 against the inner surface 320 of the opening 312, while simultaneously (com-)pressing the lip 314 against the surface 316 of the opening 312. The force applied by the bulkhead 322 to the portion 306 of the volute 302 seals the volute 302 to the sump 30, and retains the bulkhead 322 within the opening 312. As shown in at least the side view of FIG. 4, the portion 306 may include one or more additional features, such as the ribs 326 shown in FIG. 4, that, for example, provide additional sealing of the volute 302 to the sump 30. While in the example of FIGS. 3-9, the opening 312 is circular; it is contemplated that openings having other shapes could be used.

Figure 5:
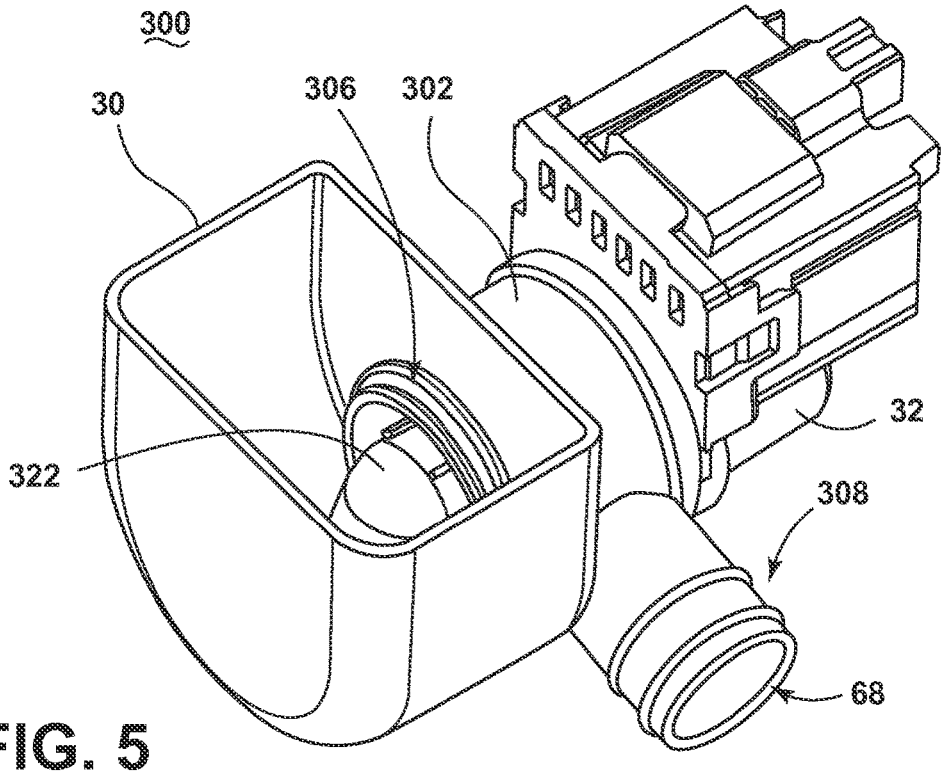
FIG. 5 is a top isometric perspective view of the example overmolded volute of FIG. 3 coupled to a sump.
Figure 6:
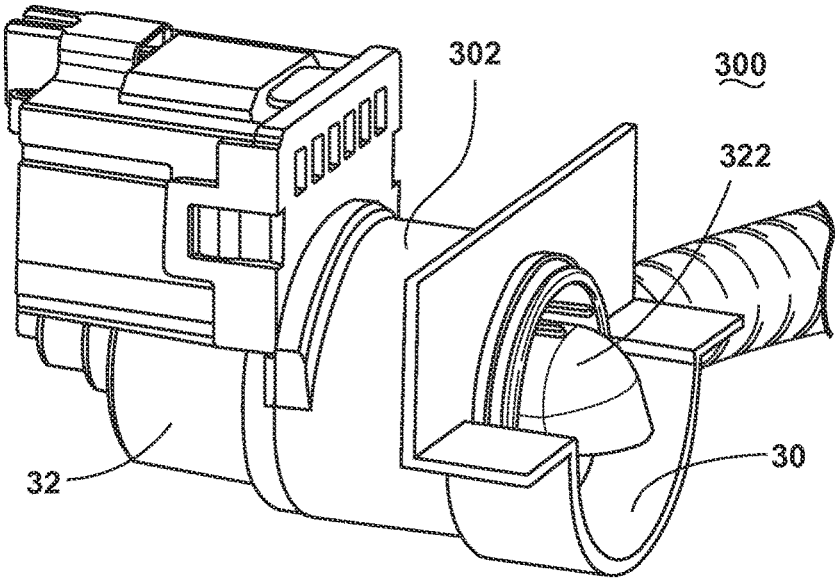
FIG. 6 is a side partial cutaway view of the example volute-sump combination of FIG. 5.

In the orientation of FIG. 5, the drain assembly 300 may be assembled by inserting the drain pump 32 into the overmolded volute 302 from the right, inserting the portion 306 of the volute 302 through the opening 312 in the sump 30 from the right, and then inserting the bulkhead 322 into the end 310 of the volute 302 from the left. However, other orders and/or directions of assembly are contemplated.

FIGS. 10-14 illustrate an example manner of implementing the example bulkhead 322 of FIGS. 3-9. The example bulkhead 400 of FIGS. 10-14 has a fluid passage way 402 defined therethrough that enables fluid to pass from the sump 30 into the volute 302. As seen in at least FIGS. 10 and 12, the fluid passageway 402 is downward turned within the sump 30 to allow the sump 30 to be more fully drained, but may cause air lock conditions. As seen in at least the cross-sectional views of FIGS. 12 and 13, the bulkhead 400 includes a peripheral 404 that seals the volute 302 to the sump 30, and retains the bulkhead 400 within an opening through the sump 30. While an L-shaped peripheral 404 is shown, other shapes are contemplated.

To vent air from the volute 302, the example bulkhead 400 of FIGS. 10-14 includes an air vent 406. The example air vent 406 enables the fluid passageway 402 to be downturned by venting air, thereby reducing or preventing air lock conditions that would normally occur with a downturned passageway. As seen in at least FIGS. 12-14, the example air vent 406 comprises an air vent hole or passageway 408 defined through the body 410 of the bulkhead 400 through which air may pass, and a rubber air vent blocker 412. As shown, when no pressure is exerted on the rubber air vent blocker 412 because the pump 32 is not operating, there is a gap between the vent blocker 412 and the body 410, which allows air to escape through the hole 408. In contrast, when the pump 32 is operating, pressure exerted against the vent blocker 412 presses the vent blocker 412 against the body 410, preventing air from passing through the hole 408. By allowing air to escape, multiple starts and stops of the drain pump 32 can be reduced or eliminated, which may increase customer satisfaction.

In more detail, the example blocker 412 is shaped to be smaller than and to be received in an opening defined into but not through the body 410. The space between the blocker 412 and the opening provides a passageway for air to the air vent passageway 408. The opening in the body is sloped toward the passageway 408, as shown. In this way, when no pressure is applied to the blocker 412, the blocker 412 is spaced from the centering of the opening and the passageway 408, and air can flow around the blocker 412 and through the passageway 408. When sufficient pressure is applied to the blocker 412, the blocker 412 flexes toward and comes into sealable contact with the opening, thereby preventing air from passing through the passageway 408.

In the example of FIGS. 10-14, the rubber air vent blocker 412 includes posts 414 that fit in corresponding holes 416 defined through the body 410 to position and/or hold the air vent block 412 relative to the air vent hole 408. However, other means of positioning and/or retaining the vent blocker 412 may be used.

While in the example of FIGS. 10-14 the bulkhead 400 is inserted and removable, the bulkhead 400 may be an integral part of an overmolded volute. For example, when a volute having an integrally molded bulkhead is overmolded onto a sump, in addition or alternative to overmolding of the volute onto a drain pump.

Figure 15:
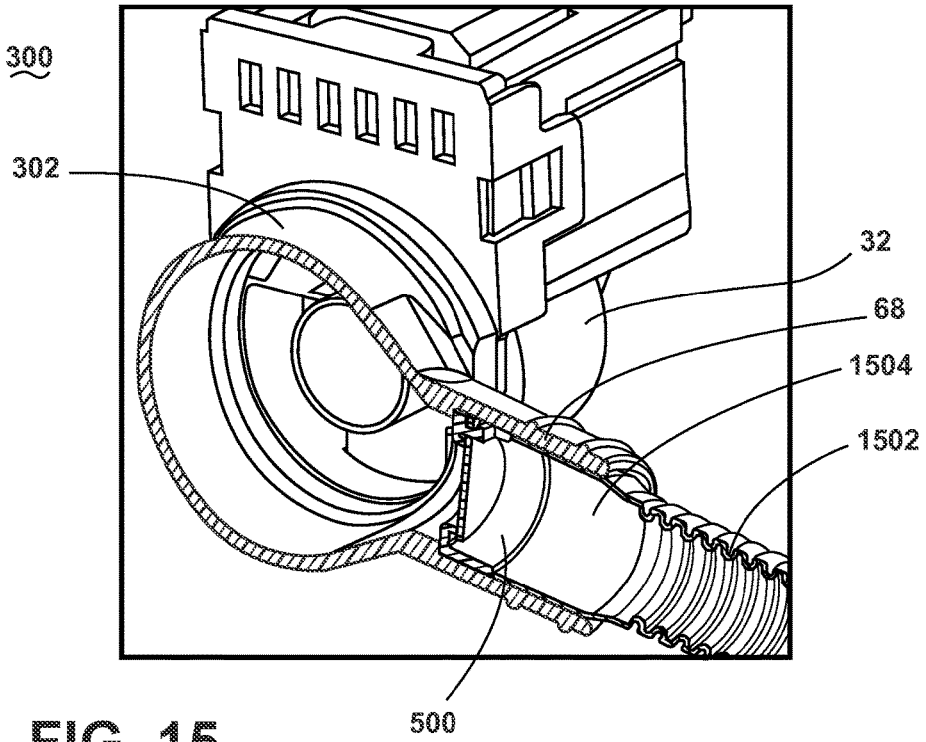
FIG. 15 is a cross-sectional view of a drain assembly outlet of the example volute of FIG. 3 and a drain hose.
Figure 16:
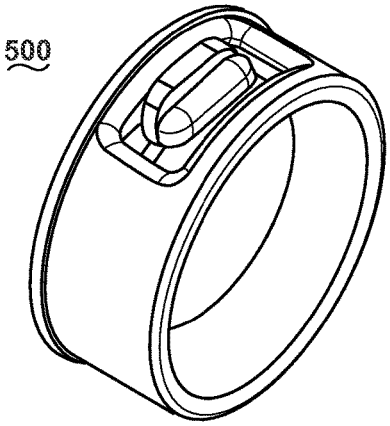
FIG. 16 is a front isometric perspective view of the example check valve assembly of FIG. 15.
Figure 17:
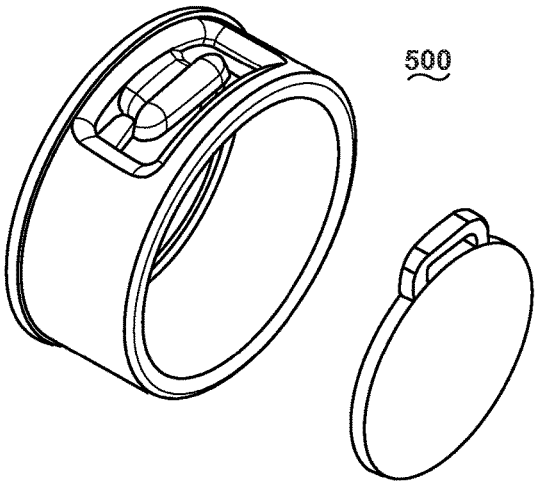
FIG. 17 is an exploded view of the example check valve assembly of FIGS. 15 and 16.

FIGS. 15-17 illustrate an example manner of fluidly coupling the discharge outlet 68 of the example drain assembly 300 to a drain hose 1502. Because the example volute 302 and the discharge outlet 68 are an integral overmolded rubber member, the drain hose 1502 does not need a separate overmold. Instead, a clamp can readily seal the volute discharge outlet 68 to the hard plastic end 1504 of the drain hose 1502.

To prevent backflow, the example discharge outlet 68 of FIG. 15 includes a check valve assembly 500. An example manner of implementing the check valve assembly 500 is shown in FIGS. 16 and 17, however, other check valve assemblies may be used. The check valve assembly 500 can be press fit into the discharge outlet 68, as shown, or may be placed elsewhere within the hose 1502.

In this specification and the appended claims, the singular forms "a," "an" and "the" do not exclude the plural reference unless the context clearly dictates otherwise. Further, conjunctions such as "and," "or," and "and/or" used in this specification and the appended claims are inclusive unless the context clearly dictates otherwise. For example, "A and/or B" includes A alone, B alone, and A with B; "A or B" includes A with B, and "A and B" includes A alone, and B alone. Further still, connecting lines, or connectors shown in the various figures presented are intended to represent example functional relationships and/or physical or logical couplings between the various elements. It should be noted that many alternative or additional functional relationships, physical connections or logical connections may be present in a practical device. Moreover, no item or component is essential to the practice of the embodiments disclosed herein unless the element is specifically described as "essential" or "critical".

Although certain example methods, apparatus and articles of manufacture have been described herein, the scope of coverage of this patent is not limited thereto. On the contrary, this patent covers all methods, apparatus and articles of manufacture fairly falling within the scope of the claims of this patent.

What is claimed is:

1. A drain assembly for a dishwasher having a tub, comprising:

a sump having an opening defined by an inner surface defining the opening and a second surface defining an abutment;

a drain pump having an impeller to pump fluid from the sump to a discharge outlet;

a resilient member overmolded onto at least a portion of the drain pump, the resilient member defining a volute for the drain pump, and the resilient member comprising an extension having a lip that defines an opening in the resilient member and is configured to extend into the opening in the sump;

a bulkhead comprising;

an air vent passageway defined through the bulkhead, the air vent passageway further comprising an air vent passageway opening;

an air vent blocker pressing against a surface of the bulkhead facing the drain pump blocking the air vent passageway opening and closing the air vent passageway when the drain pump operates to prevent entrance of fluid into the air vent passageway, and;

an L-shaped peripheral configured to extend into the opening of the resilient member such that the peripheral of the bulkhead compresses the extension of the resilient member against the inner surface of the sump and compresses the lip of the resilient member against the abutment of the sump.

2. A drain assembly as defined in claim 1, wherein the resilient member additionally defines the discharge outlet.

3. A drain assembly as defined in claim 2, further comprising a drain hose fluidly coupled between the discharge outlet and a domestic drain.

4. A drain assembly as defined in claim 3, wherein the discharge outlet internally receives an end of the drain hose.

5. A drain assembly as defined in claim 3, further comprising a check valve assembly positioned in the discharge outlet.

6. A drain assembly as defined in claim 5, wherein the check valve assembly fluidly decouples the discharge outlet from the drain hose when the drain pump is not operating.

7. A drain assembly as defined in claim 1, wherein the resilient member comprises:

a portion overmolded on the drain pump; and a generally hollow protrusion separate from the portion and dimensioned corresponding to the opening in the sump.

8. A drain assembly as defined in claim 7, wherein the lip of the resilient member and the sump opening are generally circular.

9. A drain assembly as defined in claim 1, wherein the bulkhead includes a passageway fluidly coupling the sump and the drain pump.

10. A drain assembly as defined in claim 9, wherein the passageway is angled downward within the sump.

11. A drain assembly as defined in claim 1, wherein the bulkhead includes a passageway fluidly coupling the sump and the drain pump, the air vent passageway and blocker positioned above the passageway.

12. A drain assembly as defined in claim 1, further comprising:

the bulkhead between the drain pump and the sump;

a fluid passageway defined through the bulkhead; and the air vent blocker spaced apart from the surface of the bulkhead allowing air to pass through the air vent passageway when the drain pump is not operating.

13. A drain assembly as defined in claim 12, where the bulkhead is integrally molded into the volute.

14. A drain pump volute for a dishwasher having a tub, a sump fluidly coupled to the tub, and a drain pump to transfer fluid from the sump to a discharge outlet, the drain pump volute comprising:

a first portion overmolded onto the drain pump;

a second portion defining a generally hollow protrusion dimensioned corresponding to an opening in the sump, the hollow protrusion having a lip extending around a distal end of the hollow protrusion, the lip engaging an interior surface of the sump adjacent the sump opening to generally prevent the hollow protrusion from being removed from the sump;

a third portion defining the discharge outlet for fluidly coupling the drain pump to a domestic drain;

the hollow protrusion having a fourth portion adjacent the lip configured to receive a bulkhead having an L-shaped peripheral configured to extend into the hollow protrusion of the second portion such that the peripheral of the bulkhead compresses that protrusion of the second portion against an inner surface of the sump and compresses the lip of the second portion against an abutment of the sump;

an air vent passageway defined through the bulkhead, the air vent passageway further comprising an air vent passageway opening; and an air vent blocker pressing against a surface of the bulkhead facing the drain pump blocking the air vent passageway opening to prevent entrance of fluid into the air vent passageway when the drain pump operates.

15. A drain pump volute as defined in claim 14, wherein the hollow protrusion and the sump opening are generally circular.

16. A drain pump volute as defined in claim 14, wherein the bulkhead defines a passageway between the sump and the drain pump.

17. A drain pump volute as defined in claim 14, wherein the bulkhead includes a fluid passageway defined through the bulkhead between the drain pump and the sump; and the air vent blocker spaced apart from the surface of the bulkhead allowing air to pass through the air vent passageway when the drain pump is not operating.

* * * * *